United States Patent [19]

Hartopp

[11] Patent Number: 4,804,005

[45] Date of Patent: Feb. 14, 1989

[54] CLEANING SYSTEM

[76] Inventor: Robert Hartopp, 85 Lower Eastern Green Lane, Coventry, West Midlands, England

[21] Appl. No.: 188,693

[22] Filed: May 2, 1988

Related U.S. Application Data

[63] Continuation of Ser. No. 865,112, May 20, 1986, abandoned.

[30] Foreign Application Priority Data

May 21, 1985 [GB] United Kingdom ..... 8512824

[51] Int. Cl.[4] ..... B08B 3/08; B08B 9/00

[52] U.S. Cl. ..... 134/57 R; 123/198 A; 134/113; 134/169 A

[58] Field of Search ..... 134/57 R, 59, 96, 98, 134/101, 103, 113, 166 R, 169 A, 169 R; 123/198 A

[56] References Cited

U.S. PATENT DOCUMENTS

| | | | |
|---|---|---|---|
| 2,187,413 | 1/1940 | Boezi | 134/169 A |
| 2,788,008 | 4/1957 | Wanzer | 134/170 |
| 3,746,027 | 7/1973 | Elliott | 137/624.18 |
| 4,082,565 | 4/1978 | Sjölander | 134/169 A |
| 4,083,399 | 4/1978 | Babish et al. | 134/103 |
| 4,176,708 | 12/1979 | Joffe | 134/169 A |
| 4,390,049 | 6/1983 | Albertson | 134/169 A |
| 4,520,773 | 6/1985 | Koslow | 134/169 A |
| 4,606,363 | 8/1986 | Scales | 134/169 A |

*Primary Examiner*—Timothy F. Simone
*Assistant Examiner*—Corinne M. Reinckens
*Attorney, Agent, or Firm*—Gifford, Groh, Sheridan, Sprinkle and Dolgorukov

[57] ABSTRACT

A cleaning system is provided for cleaning fuel injectors of deposits inhibiting their efficient operation. The system provides a circuit for cleaning fluid to be passed through the injector and includes a pump for fluid and controls whereby the fluid is passed through the injector with periodic reversals of flow. A flowmeter is provided to check the cleaning action and an electrical supply to the injector ensures it is in an open condition during cleaning. The injector is releasably located in fluid communication with the fluid.

8 Claims, 2 Drawing Sheets

CLEANING SYSTEM

This is a continuation of co-pending application Ser. No. 865,112 filed on May 20, 1986, abandoned.

This invention relates to a cleaning system particularly for cleaning fuel injectors for internal combustion engines.

Fuel injectors for internal combustion engines have been found to suffer problems due to a build-up of deposits which restrict the flow of fuel through the injectors and this build-up seriously affects the performance of the injectors so that they have to be replaced. The deposits are difficult to remove even when cleaning fluid is added to the fuel and, if the injectors have to be replaced after a relatively short time with, for example, twelve cylinder engines, twelve injectors are involved and considerable expense is incurred. The problem is further increased because, although the injectors are readily removed from the engine, they are made as integral units and cannot be disassembled to gain access to the obstructed passages.

An object of the invention is to provide a cleaning system suitable for cleaning fuel injectors.

According to the invention a cleaning system includes a closed circuit for cleaning fluid, locating means for locating an item to be cleaned releasably in communication with the circuit for passage of the fluid through the item, pump means for pumping the fluid through the circuit, and control means for controlling the flow of fluid through the circuit so that the flow of fluid through the item to be cleaned is periodically reversed.

It has been found that, in particular when the item to be cleaned is a fuel injector, by reversing the flow of the cleaning fluid through the injector ready removal of deposits in the injector passages is achieved.

Preferably the fluid used is a mixture of fuel and cleaning agent and the cleaning agent may be carburetor cleaner, for example cleaner sold under the name Forte cleaner by Forte Lubricants. Conveniently the cleaner is mixed with the fuel in the ratio of cleaner to fuel of 2:1.

The control means is preferably arranged to supply the cleaning fluid successively in one direction and then the other through the item for predetermined periods. For example the flow may be for about ten seconds in each direction over a duration of one or two minutes.

The system may include a flowmeter which may be switched into the circuit to measure the resistance to flow of the fluid through the item, for example at the beginning and at the end of a cleaning operation, to check that adequate cleaning has taken place.

The locating means may include means for making fluid-tight releasable connections at the inlet and outlet ends of the item to be cleaned. In the case of fuel injectors the injectors each have an outlet nozzle at one end and an inlet opening at the opposite end. The locating means may include a member having an opening for sealingly receiving the nozzle end and a further member with an opening for sealingly receiving the inlet end, the members being relatively movable to enable the injector to be inserted in and released from said openings. Preferably such relative movement is achieved by means of a toggle clamp.

To achieve the reversal of flow of the cleaning fluid in the circuit, valves operated by the control means are provided which switch the direction of flow of the fluid electronically for predetermined timed periods.

A reservoir of the cleaning fluid is provided which is connected to the circuit and the reservoir is preferably removable and in the form of a jug with a discharge spout so that after a cleaning operation the fluid may be discharged into the fuel tank for the engine having the fuel injectors.

Further features of the invention appear from the following description of an embodiment of the invention given by way of example only and with reference to the drawings, in which.

Figure 1:
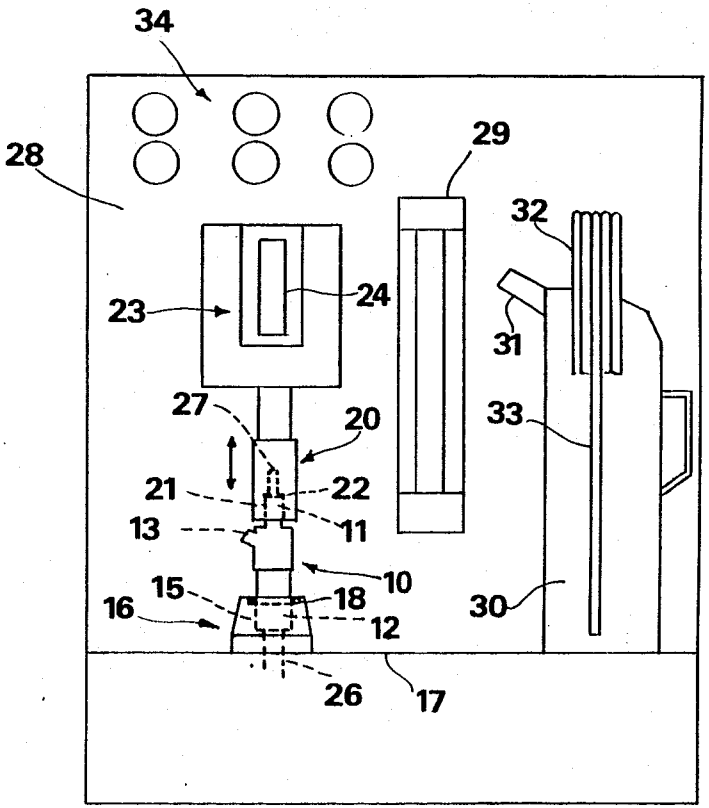
FIG. 1 is a front elevation of cleaning apparatus.
Figure 2:
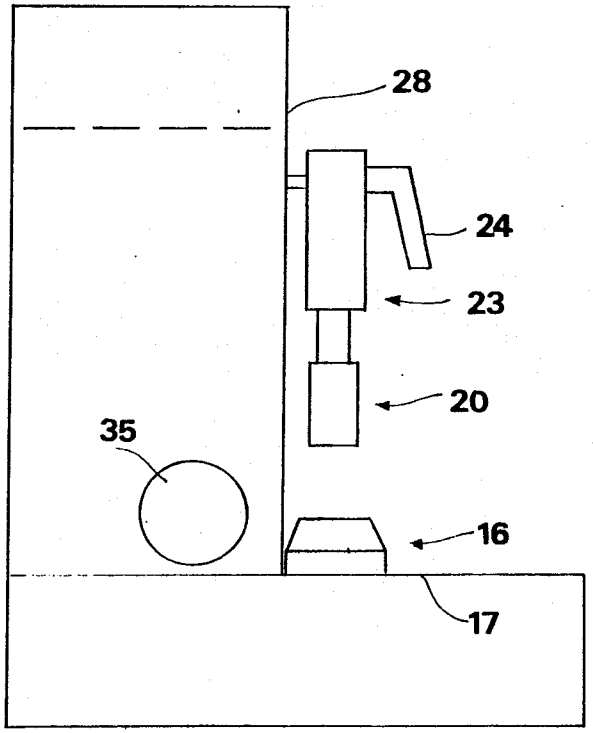
FIG. 2 is a side view of the apparatus of FIG. 1.

Referring to the drawings, the cleaning apparatus shown is intended for the cleaning of the fuel injectors of internal combustion engines. Such an injector is shown in outline in FIG. 1 at 10 and includes an inlet end 11 through which fuel is normally introduced during operation of an internal combustion engine. The injector 10 contains a solenoid-operated needle (not shown) which controls the flow of fuel through an outlet nozzle 12 during normal operation. The solenoid is operated by power supplied through electrical contacts 13 on the injector. Throughout the cleaning operation to be described the solenoid is operated to bring the nozzle 12 to its opened condition to permit flow of cleaning fluid through the injector.

The outlet nozzle 12 is releasably located in an opening 15 of a fixed member 16 mounted on a platform 17 and the opening 15 includes an O-ring sealing element 18 which sealingly engages with the injector 10, as shown.

The opposite inlet end 11 of the injector 10 is releasably located in a vertically movable member 20 through an opening 21 in the base of which is an O-ring sealing element 22. The member 20 is carried on a toggle clamp assembly 23 having a handle 24 by which the member 20 is moved towards and away from the fixed member 16 to locate the injector 10 between the members 20 and 16 as shown in FIG. 1.

The bases of the openings 15 and 21 each communicate with fluid passages 26 and 27 respectively whereby cleaning fluid is passed through the injector 10. The passages 26 and 27 form part of a closed circuit fluid circulation system such as shown in FIG. 3.

The toggle clamp assembly 23 is mounted on the front of a housing 28 for the fluid circuit, valves and control system to be described, directly above the platform 17. The front of the housing 28 also carries a flow meter 29 selectively connectable in fluid flow communication with the injector 10.

A cleaning fluid reservoir 30 in the form of a jug having a top opening and a pouring spout 31 is releasably mounted on the platform. Inlet and outlet pipes 32 and 33 gain access to the jug through the top opening and the jug can be dismounted to pour out the jug contents and to refill. On/off buttons and indicator lights 34 are located on the front of the housing 28.

Figure 3:
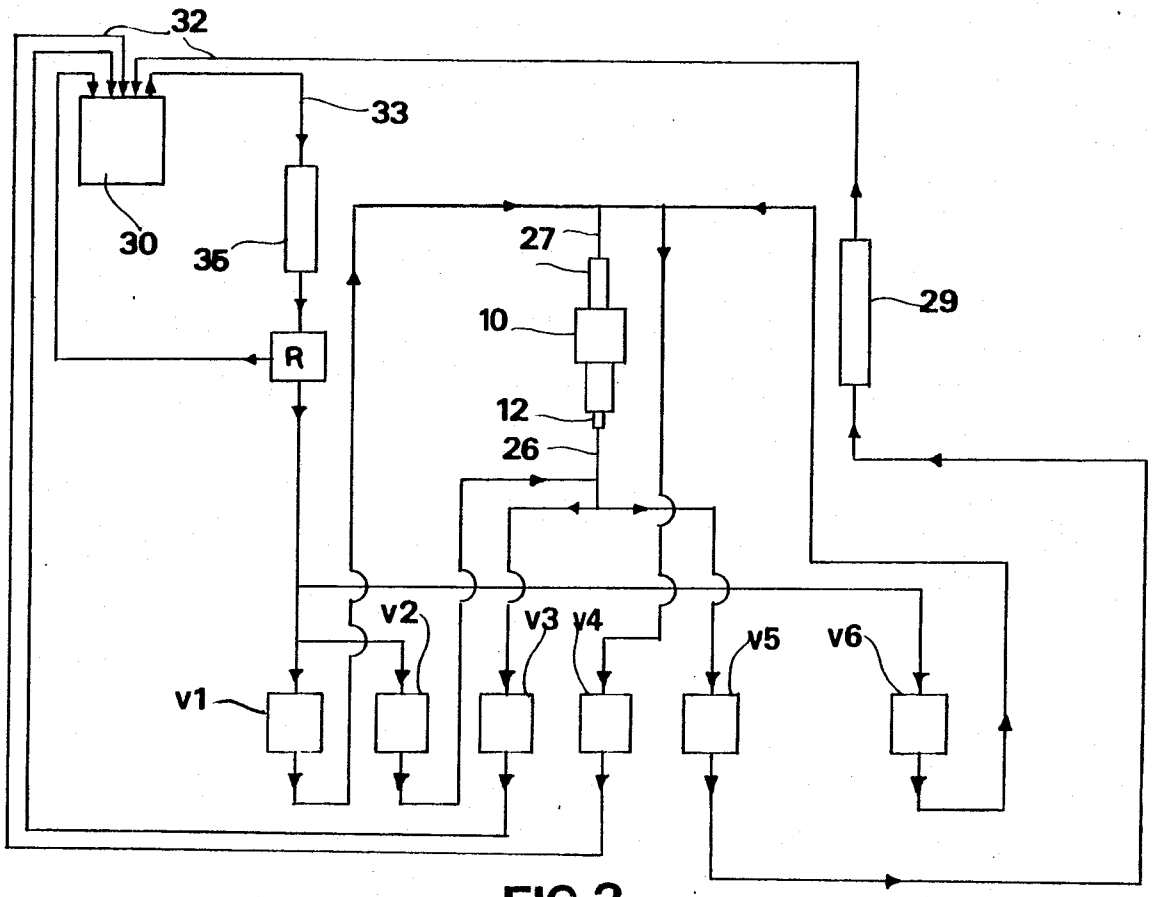
FIG. 3 is a circuit diagram of the cleaning apparatus of FIGS. 1 and 2.

Referring now in particular to FIG. 3, a cleaning fluid circuit is shown. The circuit includes a pump 35 which draws cleaning fluid through the pipe 33 from the jug or tank 30 and discharges the fluid towards a pressure release valve 36. Any excess fluid is returned to the tank 30 while operating fluid is passed to the injector 10 according to the setting of valves V1, V2, V3, V4, V5 and V6. The flow meter is indicated at 29.

The valves V1–V6 are electrically operated by control means (not shown) to allow the fluid to pass in either direction through the injector 10 or to pass through the injector from inlet 11 to outlet 12 and through the flow meter 29.

Thus with valves V5 and V6 open and valves V1–V4 closed the fluid will pass through the injector 10 and then through the flow meter 29 whereby a reading may be obtained relating to the restriction to flow of fluid through the injector 10. Normally such a reading is obtained at the commencement and at the completion of a cleaning operation to establish the need for and the effectiveness of the operation.

To effect a cleaning operation the fluid is fed alternately in one direction and then the other through the injector 10. During cleaning valves V5 and V6 are closed. Valve V1 is open and valve V3 is open when the fluid is passing from the inlet end 11 to the outlet end 12 of the injector. Valve V2 and valve V4 are open when the fluid is passed through the injector 10 in the reverse direction.

By an electronic control system (not shown) operation of the valves V1–V4 is controlled so that the fluid passes for a predetermined time, say 10 seconds, in one direction through the injector 10 and then for a similar time in the opposite direction. This action is continued automatically for a time period of, say, 1–2 minutes and is then interrupted. The valves V5 and v6 may then be opened to test the restriction to flow after cleaning and, if necessary, the cleaning operation can be repeated until full flow through the injector 10 has been achieved. The injector 10 may then be released and is ready for use.

From time to time, for example after cleaning a batch of injectors for an engine, the cleaning fluid is changed and the used fluid may be poured into a fuel tank of the engine from the jug.

Instead of the location means for the injector shown, the injector may be connected into the circuit, while still retaining the conventional flexible connection (not shown) at its inlet end 11, by adapting the member 20.

In addition to ease the location of the jug 30 on the apparatus a removable shelf (not shown) may be located under the jug for removal from under the jug before extracting the jug downwards into the space occupied by the shelf and for placing under the jug after insertion thereof.

Although the apparatus shown only has provision for one injector to be cleaned at a time it will be appreciated that the apparatus may have locations for two or more injectors in series in the circuit.

In some circumstances it is preferable that the injector be cleaned while remaining in situ in association with the engine, for example while remaining in its operative position in a vehicle. The cleaning system described can be readily adapted for this purpose by arranging for the circuit to be connected through tubing to convenient positions in the fuel supply circuit to and from the injector. Thus one tube may be connected from the passage 27 to the fuel input line to the injector and a further tube is placed in communication between the passage 26 and the injector discharge. In addition the normal electrical connector to the injector is disconnected and replaced by an electrical connector arranged to keep the injector in a permanently open condition during cleaning.

The connection between the cleaning fluid circuit and an engine-mounted injector may be achieved by substituting for the injector 10 in the illustrated arrangement a distribution member having a connector for each of the tubes, the connectors being in communication with the passages 26 and 27 respectively. It will be seen that in this way the system can be used either for injectors remaining in situ or for injectors which have been removed for a cleaning operation. In the latter case the distribution member is substituted by the injector in the manner described.

What we claim as our invention and desire to secure by Letters Patent of the United States is:

1. A cleaning system for fuel injectors which includes a closed circuit for cleaning fluid, locating means for locating an injector to be cleaned releasably in communication with the circuit for passage of the fluid through the injector, pump means for pumping the fluid through the circuit, flow rate measuring means, valve means for selectively directing fluid through the injector in one of three paths, and control means for the valve means, the paths including a first path in which fluid passes in one direction through the injector, a second path in which fluid passes in the opposite direction through the injector, and a third path in which the fluid passes through the injector and the flow rate measuring means in order to determine the cleanliness of the injector, operation of the valve means and its control means causing the cleaning fluid to pass through the injector in alternating directions and for predetermined time periods in each direction, and the flow of the fluid removing material from the surfaces of the injector flow passages.

2. A cleaning system according to claim 1 wherein flow of fluid through the injector is pulsed in opposite directions, the fluid being recycled in the closed circuit during cleaning.

3. A cleaning system according to claim 1 wherein the duration of flow in each direction during cleaning is substantially the same and is in the range 10–30 seconds.

4. A cleaning system according to claim 1 wherein the locating means includes a first member defining a first opening for sealingly receiving one end of the injector and a second member defining a second opening for sealingly receiving the other end of the injector, the openings communicating with the fluid circuit and the first and second members being relatively movable to clamp the injector releasably between the members.

5. A cleaning system according to claim 4 wherein the members are relatively movable by a toggle clamp.

6. A cleaning system according to claim 1 wherein the control means includes valve means operated electrically to open and close in sequence and to effect said reversal of flow for predetermined time periods in each direction.

7. A cleaning system according to claim 1 comprising a reservoir for cleaning fluid in fluid communication with the circuit, the reservoir being removable and in the form of a jug so that, after a cleaning operation, the jug may be removed and emptied.

8. A cleaning system according to claim 1 comprising an electrical connector for supplying power to the injector to operate the injector to an open condition during a cleaning operation.

* * * * *

UNITED STATES PATENT AND TRADEMARK OFFICE

CERTIFICATE OF CORRECTION

PATENT NO. : 4,804,005

DATED : Feb. 14, 1989

INVENTOR(S) : Robert Hartopp

It is certified that error appears in the above-identified patent and that said Letters Patent is hereby corrected as shown below:

In the patent heading at Item "(73) Assignee:", please add

--Barwood Engineering Limited,

West Midlands, ENGLAND --

Signed and Sealed this

Sixteenth Day of October, 1990

*Attest:*

HARRY F. MANBECK, JR.

*Attesting Officer*

*Commissioner of Patents and Trademarks*